US006868614B2

(12) United States Patent
Floied et al.

(10) Patent No.: US 6,868,614 B2
(45) Date of Patent: Mar. 22, 2005

(54) TARGET SIGHT AND RANGE FINDER

(75) Inventors: Charles R. Floied, Nunnelly, TN (US); Stevey Maynard, Leander, TX (US); Ricky L. Maynard, Liberty Hill, TX (US); Jerry D. Maynard, Bertram, TX (US)

(73) Assignee: Rack-Spur LLC, Nunnelly, TN (US)

( * ) Notice: Subject to any disclaimer, the term of this patent is extended or adjusted under 35 U.S.C. 154(b) by 0 days.

(21) Appl. No.: 10/386,934

(22) Filed: Mar. 13, 2003

(65) Prior Publication Data

US 2004/0107587 A1 Jun. 10, 2004

Related U.S. Application Data

(60) Provisional application No. 60/363,547, filed on Mar. 13, 2002.

(51) Int. Cl.[7] ..... F41G 1/467
(52) U.S. Cl. ..... 33/265; 124/87
(58) Field of Search ..... 33/265; 124/87, 124/88

(56) References Cited

U.S. PATENT DOCUMENTS 3,521,362 A * 7/1970 Duplechin ..... 33/265
3,666,368 A * 5/1972 Sprandel ..... 356/21
4,497,116 A * 2/1985 Hawkins ..... 33/265
4,555,856 A * 12/1985 Brown ..... 33/265
5,305,530 A * 4/1994 Robertson, Jr. et al. ..... 33/265
5,359,780 A * 11/1994 Dallaire ..... 33/265
5,442,862 A * 8/1995 Newbold et al. ..... 33/265
5,465,491 A * 11/1995 Thell ..... 33/265
5,651,185 A * 7/1997 Vanderheyden et al. ..... 33/265
5,718,215 A * 2/1998 Kenny et al. ..... 124/87
5,920,996 A * 7/1999 Hurckman et al. ..... 33/265
6,061,919 A * 5/2000 Reichert ..... 33/265
6,119,672 A * 9/2000 Closson ..... 124/87
6,430,821 B1 * 8/2002 Cionni ..... 33/265
6,505,407 B2 * 1/2003 Savage ..... 33/265
2003/0136012 A1 * 7/2003 Walbrink ..... 33/265

* cited by examiner

*Primary Examiner*—G. Bradley Bennett
(74) *Attorney, Agent, or Firm*—Miles & Stockbridge P.C.; Edward J. Kondracki

(57) ABSTRACT

A combined target sight and range finder with a bulls-eye pin and slotted sight plate that receives an adjustable "belly bar" is disclosed. A "set-in" procedure is used to establish a set-in distance and to generate a scale of various target sizes. The "set-in" procedure involves adjusting such that the bulls-eye pin is consistently aimed at the bulls-eye of a target, yet hits the target at a distance above the target. The archer moves progressively farther away from the target until a "set-in" distance at which aiming at the bulls-eye produces shots that hit the bulls-eye is reached. Various targets are presented at the set-in distance, and the belly bar is positioned such that the bulls-eye pin and belly bar frame each target. The belly bar can then later quickly be placed in its slot at the position corresponding to the target size, thereby accounting for the distance between the shooter and the target.

2 Claims, 4 Drawing Sheets

TARGET SIGHT AND RANGE FINDER

CROSS-REFERENCE TO RELATED APPLICATIONS

This application claims the benefit of the filing of U.S. Provisional Application No. 60/363,547, filed Mar. 13, 2002. The contents of the provisional application are hereby expressly incorporated by reference.

BACKGROUND OF THE INVENTION

1. Field of the Invention

The present invention relates to target sights to be used particularly in bow hunting and other archery activities, and more particularly to sights which include range finders.

2. Description of the Related Art

Many attempts have been made previously to design and produce a sight that will compensate or adjust the sight for varying distances between a projectile launcher, such as an archery bow, and the intended target. In such designs, the failure to provide the required degree of accuracy and ease of use have prevented the designs from making any significant impact in the archery industry. The cost of manufacture of such designs and the projected retail prices have also hindered any widespread adoption of designs proposed to date.

The relatively recent introduction and wide popularity of compound bows has further added to the difficulty of designing a combined sight and range finder. Compound bows allow for a wide variety of arrow speeds (initial velocity), both among different bow designs and among different users of particular types of bow. The range of possible arrow speeds with the bows in use today is from about 150 feet per second (fps) to about 350 fps. This range of possible arrow speeds has made certain designs useful only for a small variety of available bows. The required accuracy cannot be realized across this entire range.

Other designs have proven to be too cumbersome to adjust to different target sizes at varying distances, requiring slow or complicated operations to adjust for these criteria, as well as for varying arrow speeds.

For example, U.S. Pat. No. 3,666,368, issued to Sprandel, discloses an archery sight and range finder which employs a trigger mechanism to slide two sight bars along a vertical track, with one sight bar moving a greater distance than the other for a given pull of the trigger. This enables the sight bars to be moved farther apart and closer together, as appropriate, to frame targets located at different distances. The patent discloses that the length of one of the links can be adjusted by turning a finger knob to accommodate the use of the sight for different sized targets. This adjustment is fairly complicated to achieve, and is not useful for making such adjustments in the field when encountering game or other targets of varying sizes. In addition, the use of a bulls-eye sight disposed on the lower bar, and designed to be used to sight between the bars, limits the distances at which the sight may be used. It also introduces potential error due to the fact that the bulls-eye sight is at a fixed distance from the lower bar, whereas the actual target area (generally, the heart region) on a given type of game will be at a different height relative to the upper and lower bars framing the target. Further, the patent does not address any means by which the sight and range finder can be adapted for use with varying arrow speeds which are a result of the various bow designs now available, the various arrow designs, and the differing manner in which the bows are used by archers (e.g., amount of string pull to "full draw").

The Reichert patent, U.S. Pat. No. 6,061,919, addresses the more modern-day concern as to how to adapt a sight and range finder to varying arrow speeds, in addition to varying target sizes. The solution proposed by Reichert is to change out cam elements in the device to make these adjustments. An initial cam selection process may be made for a given bow used by a given archer, however, that process is time consuming and tedious. Beyond that, the requirement to then change out cam components as an adjustment for varying target sizes means that this design is not well suited for adjustments being made in the field upon encountering game or other targets of varying sizes.

It is a principal object of the present invention to provide a target sight which overcomes the disadvantages of the designs previously proposed.

More specifically, it is a principal object of the present invention to provide a combined sight and range finder which can be set up or calibrated for a wide variety of bow speeds/arrow speeds, in a relatively simple manner.

It is a further principal object of the present invention to provide a combined sight and range finder which can be quickly adjusted in the field for various target sizes that may be encountered.

It is yet a further principal object of the present invention to provide a highly reliable and accurate combined sight and range finder which can provide accuracy to distances on the order of 70–75 or more yards.

It is an additional principal object of the invention to provide a simple sight/range finder set up procedure which takes into account the specific bow speed/arrow speed of each individual bow and shooter.

SUMMARY OF THE INVENTION

The above and other objects of the present invention are realized in the combined target sight and range finder of the present invention. It is to be noted that, while most of the discussion herein will be directed to an embodiment which is especially suited for use as a bow sight for archery applications, the sight/range finder will be readily adapted for use in many other types of redundant launching or shooting, meaning that the initial velocity or the trajectory characteristics of the projectile remain substantially constant from launch-to-launch or shot-to-shot. It may also be noted herein, with respect to the use of the device as a bow sight, that the term "arrow speed" is not used strictly to refer to the initial velocity of the arrow as it is launched by the bow. It will be recognized that other trajectory characteristics for a particular arrow, such as its weight, drag, center of gravity, etc., also have an effect on the trajectory of a particular arrow. For the sake of simplicity, however, all of the characteristics of a particular arrow which contribute to its flight trajectory will be included when reference is made to the "arrow speed". The "arrow speed" of an arrow, as used herein, is largely determined by the bow rating or construction and the particular operation of a given bow by a given archer. As used herein "arrow speed" is determined based upon a particular archer's "full draw" of the bow that he/she is operating.

The bow sight/range finder employs an essentially standard bracket for mounting the sight to the bow, and has essentially standard windage and elevation adjustment devices coupling the mounting bracket to the remainder of the sight. The elevation adjustment device includes a substantially vertically oriented main frame member, from which a lower link depends, with the lower link being angled slightly forwardly. A sight plate is pivotably mounted at a lower front face of the main frame member. The sight plate is roughly in the shape of a lower case "H", having its leg extending vertically upwardly and then angled further upwardly and forwardly to a forward sight bar, which is preferably substantially parallel to the main frame member when at an initial or starting position.

A lower end of the forward sight bar has a forward link pivotably connected thereto. The pivot axis between these two components, when the frame is at the initial or starting position, is at substantially the same level as is the sight plate pivot axis on the main frame member. Forward link is of a length such that, when the frame is in the initial or starting position, it may be pivotably connected to a trigger link extending between the forward link and lower link extending downwardly from the main frame member. Trigger link is pivotably connected to both the forward link and the lower main frame link with the pivot axis being at substantially the same level when the frame is at the initial or starting position.

Forward sight bar has a bulls-eye pin protruding laterally therefrom. The forwardly angled portion of the sight plate is slotted to receive an adjustable "belly bar" protruding laterally therefrom, substantially parallel to the bulls-eye pin. The belly bar-is positioned in the slot at a position corresponding to the size (in profile) of the upper and lower extents of the type of target being shot. The trigger is pulled as necessary to move the frame from its initial or starting position to a position such that the bulls-eye pin and the belly bar frame the upper and lower extents of the profile of the target. When the sight has been previously properly calibrated or "set-in", this framing of the target by a simple pull of the trigger functions to properly range the distance to the target.

The "set-in" procedure involves standing at an initial predetermined distance from the target and adjusting the windage and elevation adjustment devices such that the archer will, at "full draw" of the bow string (a repeatable distance of string draw or displacement unique to each archer) consistently have the bulls-eye pin aimed at the bulls-eye of a target, yet hit the target a predetermined distance above the target. These adjustments are of a fairly routine nature for bow sights, albeit the adjustments are generally made such that aiming at the bulls-eye results in hitting the bulls-eye.

Once the adjustments are made such that the archer is hitting higher than the bulls-eye by the predetermined amount, the archer will move progressively farther away from the target in increments until shooting from a distance at which aiming at the bulls-eye produces shots which hit the bulls-eye. At that distance, referred to herein as the "set-in distance", and with the sight in its initial or starting position, various targets of different standard sizes are presented, and, as each target is presented, the belly bar is positioned such that the bulls-eye pin and belly bar frame the target. A scale provided on the upper surface of the link above the slot in which belly bar travels is marked for the position of the belly bar for each of the target sizes.

With the target sight set up in this manner, the archer may go into the field, and, when encountering a particular type of game, will be able to quickly set the belly bar in its slot at the position corresponding to the size of that type of game, and then to pull the trigger from its initial position as necessary to frame the top and bottom of the game. By operation of the sight linkages, both the bulls-eye pin and belly bar will rotate. The archer will, however, see substantially only vertical movement of the bulls-eye bar/pin and belly bar, in which the bars come closer together or move further apart, as necessary, to frame the target. As the bulls-eye pin begins dropping, the archer must raise the front of the bow to maintain the bulls-eye pin at the top of the target, and when the target is framed, the shooting angle of the bow has been raised to account for the distance between the shooter and the target. The archer will then preferably drop the bulls-eye pin to the portion of the target that is to be hit.

The relative sizes and relative rotations of the links of the sight, as well as the use of the unique "set-in" procedure, provide a very simple system for achieving highly accurate ranging and aiming at a variety of potential targets, once the straightforward and relatively simple set-in or calibration procedure has been used to establish a set-in distance and to generate a scale of various target sizes.

BRIEF DESCRIPTION OF THE DRAWINGS

These and other features of the present invention will be better understood from the ensuing detailed description of the preferred embodiments of the invention, taken in conjunction with the accompanying drawings, in which like reference numerals are used to represent like parts, and in which.

DETAILED DESCRIPTION OF THE PREFERRED EMBODIMENTS

Figure 1:
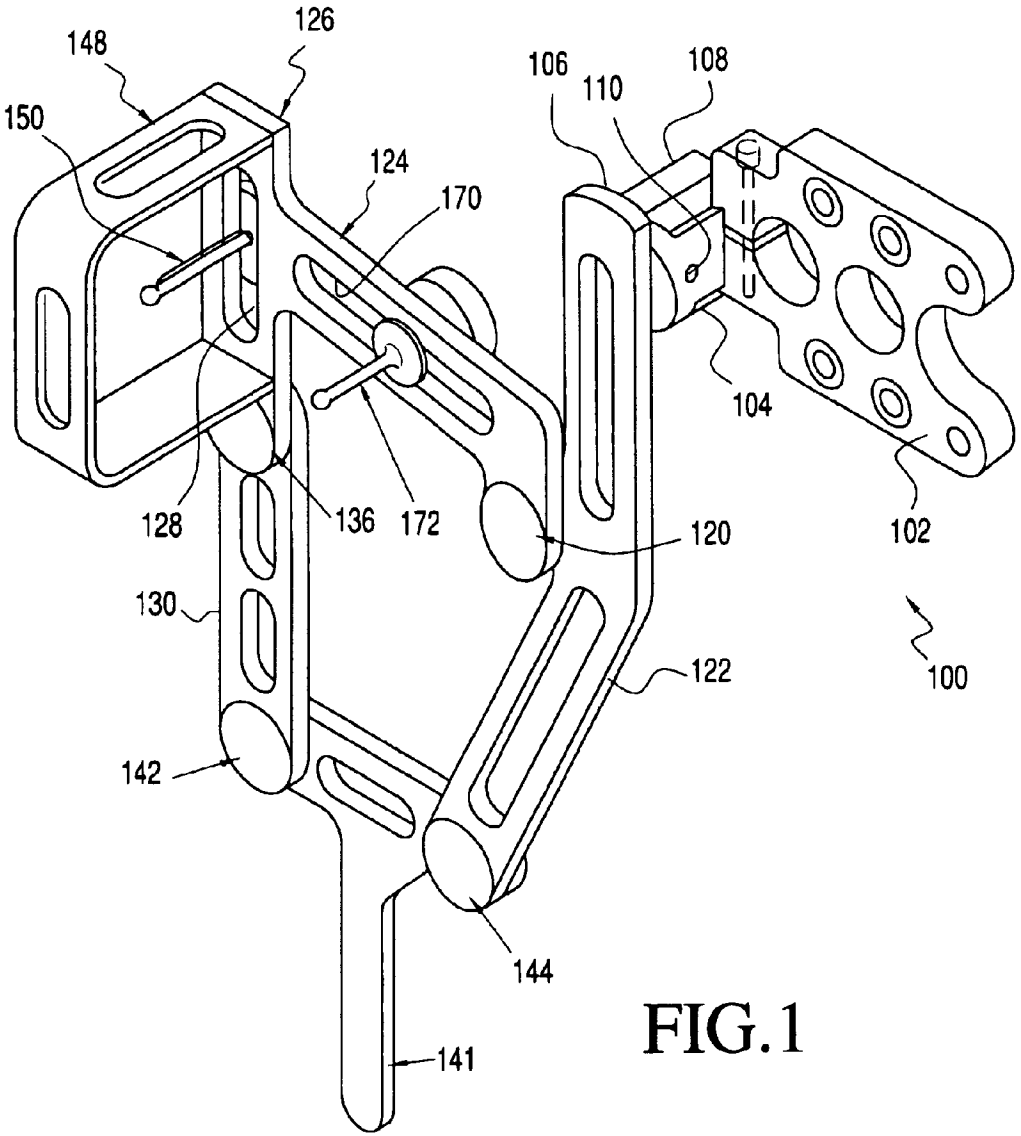
FIG. 1 is a rear perspective view of the target sight and range finder in accordance with a preferred embodiment of the present invention.

Referring initially to FIG. 1, a target sight/range finder 100 (hereafter "sight") according to a preferred embodiment of the invention is illustrated. The sight 100 is equipped with a bow mount or mounting bracket 102, for securing the sight to a bow. As is more-or-less standard in the art of bow sights, the bow mount 102 has a plurality of sets of bores through which mounting screws can be inserted to mount sight 100 to a bow at varying relative positions, based upon several parameters involving the archer, including his/her physical size, the position at which the bow is held relative to the archer's head and eye, etc.

Sight 100 has an adjustment bar 104 which couples bow mount 102 to main sight frame member 106. The adjustment bar 104 extends in a substantially horizontal orientation, and is adjustably secured to bow mount 102. This is preferably accomplished by providing adjustment bar 104 with a protruding dovetail profile, and by providing bow mount 102 with a complementary sized and shaped dovetail recess, within which the adjustment bar can slide transversely to the shooting direction. A bow mount dovetail screw 108 is provided, which is adapted to clamp the walls of the dovetail recess onto the protruding dovetail profile to secure the adjustment bar at a desired transverse position.

Adjustment bar 104 is provided, at its terminal end, with a vertically oriented dovetail recess, which is adapted to receive therein a dovetailed projection extending along the length of main frame member 106. An adjustment bar dovetail screw 110 is preferably provided, and is operable to clamp the dovetailed projection of the main frame member within the dovetail recess.

Main frame member 106 is preferably oriented in a substantially vertical orientation when the bow is held in its substantially vertical orientation. Main frame member has a lower link element 112 depending downwardly therefrom and angled slightly forwardly (in the direction of a target). Main frame member 106 has a flange 114 extending forwardly at a lower extent thereof, just above lower link element 112. Flange 114 has a bore 116 extending therethrough.

Sight plate 118 is pivotably connected to main frame member 106 by a clutch bolt 120 extending through frame member bore 116 and a corresponding bore 122 disposed at the lower extent of rear leg 124 of sight plate 118. Clutch bolt 120 is of a known construction and may be adjusted by turning an external wheel to either increase or decrease the resistance to the pivoting of sight plate 118 relative to main frame member 106. This allows the user to adjust the force which must be exerted on a trigger to move the sight elements in the ranging operation.

Rear leg 124 extends upwardly from bore 122 for a short distance, and then is angled upwardly and forwardly at an approximately 20°–60° angle, and more preferably at about 30°–40° angle, and even more preferably at about a 32.5° angle, from a substantially horizontal plane (with main frame member 106 being in a substantially vertical plane). Forward sight bar 126 is disposed at the forward end of rear leg 124, and in the starting or initial position of the sight 100 (FIG. 2), is preferably at a substantially parallel orientation to main frame member 106.

Forward sight bar 126 extends both upwardly and downwardly from the area at which it connects to rear leg 124. A slot 128 is present in forward sight bar 126, which slot extends along a substantial portion of the length of the forward sight bar.

At a lower end of forward sight bar 126, a bore 127 is provided. This bore is adapted to be pivotably joined to forward link 130, which extends downwardly from forward sight bar 126. Forward link 130 is preferably a straight link member having bores 132, 134, at its upper and lower ends. Forward link is pivotably connected to forward sight bar by a pivotal nut 136, extending through the bores of those elements.

Figure 2:
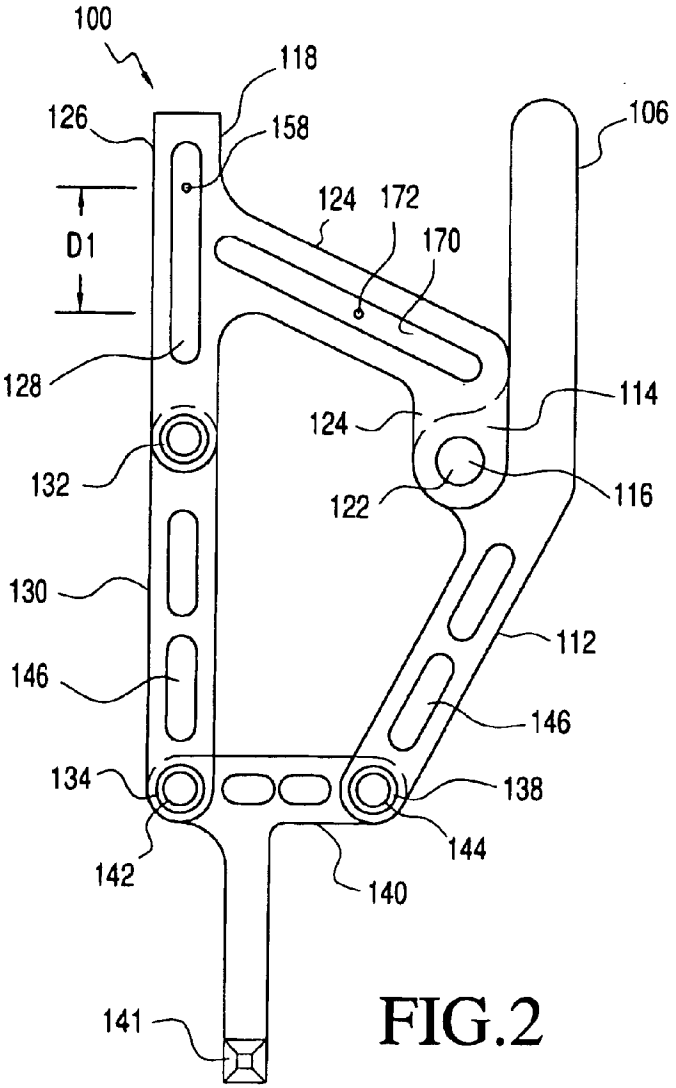
FIG. 2 is a side elevation view of the target sight and range finder at an initial position, in accordance with a preferred embodiment of the present invention.

The length of forward link 130 is preferably selected such that the bore 134 at the lower end thereof is at substantially the same level as is a bore 138 disposed at a lower end of lower link element 112, when the sight is in the initial or starting position (FIG. 2). A trigger link 140 is sized such that it may be pivotably connected to forward link 130 and to lower link element 112 at the respective bores 134, 138. Trigger link 140 is provided with forward and rear bores, and additional pivotal nuts 142, 144, of known construction are employed to pivotably connect the trigger link to the forward link and the lower link element.

Trigger link 140 has a trigger 141 extending downwardly therefrom, which trigger is positioned to be within easy grasp of the archer using the bow. The lengths of forward link 130 and lower link element 112 are selected in part to enable the trigger link and depending trigger to be at such a position to enable easy access.

Each of the main frame member, the sight plate, the forward link, the trigger link, and the lower link elements of main frame member may preferably be constructed from an aluminum alloy, such as Aluminum 6061, which is preferably anodized to a black finish. The use of an aluminum alloy provides the necessary strength at low weight, and the black finish reduces or eliminates glare and reflection. As a further weight-reduction measure, the bodies of one or more of the link elements may be milled to partially or completely remove material from the link, as is illustrated by the presence of grooves 146 in the forward link, the trigger link, and the lower link element.

The sight plate has a sight guard 148 extending transversely to the target direction. As illustrated, the sight guard is preferably a substantially squared-off U-shaped section of black anodized aluminum secured to an upper end of forward sight bar, and to a lower end of forward sight bar above bore 132. This sight guard protects a bulls-eye pin 150 mounted to sight bar 126 from impact, and also aids in shielding light and glare which may interfere with the archer attempting to aim at a target.

Figure 5:
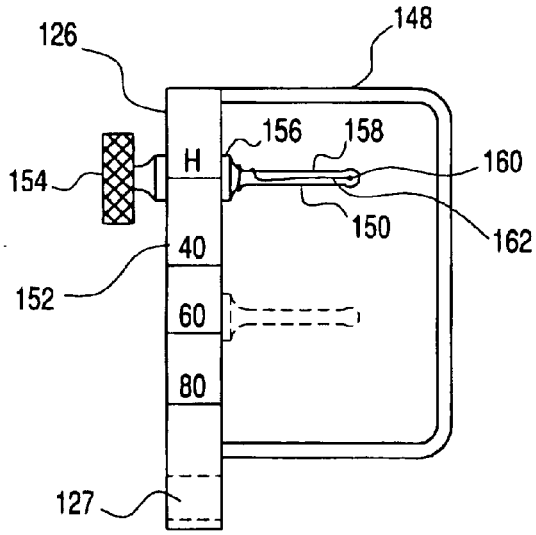
FIG. 5 is a front elevation view of the sight bar of the present invention, according to a preferred embodiment.

As noted previously, forward sight bar 126 has a slot 128 extending along the majority of its length. Slot 128 is employed to mount a bulls-eye pin 150 to the forward sight bar 126. In the illustrated preferred embodiment, the bulls-eye pin 150 is mounted such that its vertical position along forward sight bar can be changed to accommodate various shooting distances. As can be seen in FIG. 5, distance scale 152 is preferably provided on the front surface of the forward sight bar. The distance scale will preferably have a marking for a "home" position H which is used for performing the basic "set-in" or calibration process. The scale can also be marked by the archer with one or more "known distance" markings that have been determined by shooting to hit bulls-eyes at various distances of interest (40, 60, 80 yards shown as an example).

The bulls-eye pin is secured to the forward sight plate by a thumbscrew 154 extending through slot 128, which can be loosened to allow the bulls-eye pin to be moved as desired within the slot, and tightened to secure the bulls-eye pin at the desired position within the slot. The function and operation of this thumbscrew will be readily understood by persons of ordinary skill in the art.

The bulls-eye pin is preferably made of aluminum or other metal, and comprises a base 156 which abuts up against forward sight bar 126, and a thin, needle-like rod 158 extending orthogonally to the base. At its end farthest from the base, the rod has an opening 160 adapted to receive and retain therein an end of an optical fiber 162. The optical fiber 162 is preferably of a small diameter, for example, between about 0.019" to about 0.029" in diameter. The end of the optical fiber 162 is positioned through the opening, and will appear to the archer as a small, bright dot which is to ultimately (e.q., after ranging) be aimed at the target area of the target.

The angled portion of rear leg 124 also has a slot 170 extending along the majority of its length. This slot 170 is adapted to retain a second needle-like rod 172, which will be referred to alternatively herein as a "belly bar". The belly bar 172 is secured to the rear leg 124 by a thumbscrew 174, which is essentially identical to the thumbscrew employed to hold bulls-eye pin 150 in place.

Belly bar 172 includes a base 176 which abuts up against the rear leg 124, and a thin, needle-like rod 178 extending orthogonally to the base. Belly bar 172 may be constructed in a manner similar to bulls-eye pin 150, including having one or more openings along its length (e.g., at the base end and at the end farthest from the base), into which the ends of optical fibers are placed (not shown). This will aid in making the level of the belly bar more clear to the archer viewing through the sight. The belly bar 172 and bulls-eye pin 150 are used by the archer in the ranging function of the sight, as will be discussed in further detail below. The belly bar 172 may alternatively be a substantially solid pin-like element.

As is the case with all archery sights, the sight 100 must undergo some initial adjustments once mounted on a bow. An archer will mount the sight to a bow with mounting bracket 102. The archer will then perform basic windage and elevation adjustments by standing at a predetermined distance from the target, for example, at 15 yards, and shooting arrows at a bulls-eye or other small target area. In this basic setup, the archer aims the fiber optic "bead" i.e., the end of the optical fiber inserted through the opening in bulls-eye pin 150, at the target, and shoots a succession of arrows. As is known, the archer must repeatedly and reliably bring the bow string to what is referred to as the "full draw" position for that particular archer. The "full draw" position will vary somewhat from archer to archer, based upon the archer's physical size and strength, which affect how far the archer will pull the bow string. Different bows will also be pulled to different "full draw" positions by a particular archer. As is known in the art, the important criterion is that the archer be consistent in pulling the bow string to the same "full draw" position each time.

In between shots or groups of shots, a windage adjustment may be made to account for any side-to-side discrepancies between the point aimed at and the point(s) where the arrows actually hit the target. The windage adjustment is made in the present invention by moving adjustment bar 104 transversely relative to bow mount 102, to bring the shots to the center of the target. As is common practice, a windage shim or shims (not shown) may preferably be provided with the sight 100, in the event that the sight 100 must be mounted away from the surface of the bow in order to obtain the proper windage correction.

The elevation adjustment is made by moving main frame member 106 vertically relative to adjustment bar 104 within the dovetail recess. The elevation adjustment as preferably used herein marks the beginning of a departure from prior art elevation adjustment processes. In the prior art, the archer will aim a bulls-eye pin or marker at a particular spot, generally the bulls-eye of a target, and will adjust the elevation of the sight to a point where the archer consistently hits the bulls-eye. In the present invention, an initial set-in or calibration procedure will have the archer adjust the elevation of the sight such that, when aiming at the bulls-eye, the arrow or arrows hit the target at a point that is a predetermined distance above the spot on the target that would normally represent an accurate shot. In the case of shooting from approximately 15 yards away from the target, for example, experimentation has shown that the predetermined distance can preferably be about two inches (2") high of the point at which the arrow was aimed.

It is to be noted that, while the position of the bulls-eye pin 150 is vertically adjustable, it is preferred that the bulls-eye pin be fixed at a predesignated "home" position (H, see FIG. 5) at or near the upper end of slot 128 while this elevation calibration is performed. The "home" position is, as noted previously, preferably marked on the scale 152 at the front surface of forward sight bar 126. The initial elevation adjustment is preferably made by adjusting the height of main frame member 106 relative to adjustment bar 104. As is known in the art, an elevation bracket (not shown) is preferably provided with the sight 100 to allow the archer to move the position of the entire sight vertically, in the event that the range of vertical adjustment for main frame member 106 is insufficient to accomplish the objetive.

Once the elevation adjustment achieves the result of arrows hitting the target a predetermined distance above the spot at which the bulls-eye pin 150 is aimed, the archer continues the calibration or set-in process by incrementally moving farther away from the target and shooting additional arrows at the target while aiming the bulls-eye pin at the same spot (e.g., the bulls-eye) as before. If the arrows continue to hit high of the spot, the archer will continue to move back from the target until shots begin to consistently hit the aimed-at spot, such as the bulls-eye.

The increments at which the archer moves back from the target may be any of one or more feet, half-yards, yards, or the increments may be left up to the archer himself. For example, if an archer begins the process by standing 15 yards from the target and adjusting the elevation of the sight to hit two inches (2") high of the aimed-at spot, and then moves back one yard (to a distance of 16 yards), and finds that he is still hitting the target nearly 2 inches above the spot, then he/she may move back several yards in the next increment, and see how close the arrows hit to the aimed-at spot. It will be readily understood by those of ordinary skill in the art that if, in performing this calibration or set-in procedure, the arrows begin to hit below the spot, then the archer will need to move closer to the target.

The distance from the target at which, using the above-described procedure, the archer will regularly hit the spot that is aimed at, will be referred to as the "set-in" distance for that particular archer using that particular bow and arrow. It has been determined, through experimentation, that the "set-in" distance using the sight of the present invention will generally fall between 15 and 35 yards, based upon the combinations of bows and arrows available on the market today, and based upon the typical range of "full draws" that various archers will employ with these bows.

The determination for this "set-in" distance is the aspect of the invention which makes the sight especially accurate at a wide range of distances, for example, from about 15 yards to about 75 yards, and more. If the arrow speed is actually known in advance, or can be accurately estimated, a lookup chart may be referred to in order to determine what the set-in distance should be. TABLE I below provides an example of a lookup chart, with the column headed "F.P.S." representing initial arrow speeds in feet per second.

TABLE I

SET IN YARDAGES

| F.P.S. | YARDS | FEET | INCHES | TENTHS |
|---|---|---|---|---|
| 130 | 10 yrds. | 2 ft. | 11 in. | .8 |
| 131 | 11 yrds. | 0 ft. | 4 in. | .8 |
| 132 | 11 yrds. | 0 ft. | 10 in. | .1 |
| 133 | 11 yrds. | 1 ft. | 3 in. | .4 |
| 134 | 11 yrds. | 1 ft. | 8 in. | .7 |
| 135 | 11 yrds. | 2 ft. | 2 in. | .0 |
| 136 | 11 yrds. | 2 ft. | 7 in. | .3 |
| 137 | 12 yrds. | 0 ft. | 0 in. | .6 |
| 138 | 12 yrds. | 0 ft. | 5 in. | .9 |
| 139 | 12 yrds. | 0 ft. | 11 in. | .2 |
| 140 | 12 yrds. | 1 ft. | 4 in. | .5 |

TABLE I-continued

| SET IN YARDAGES | | | | |
|---|---|---|---|---|
| F.P.S. | YARDS | FEET | INCHES | TENTHS |
| 141 | 12 yrds. | 1 ft. | 9 in. | .8 |
| 142 | 12 yrds. | 2 ft. | 3 in. | .1 |
| 143 | 12 yrds. | 2 ft. | 8 in. | .4 |
| 144 | 13 yrds. | 0 ft. | 1 in. | .7 |
| 145 | 13 yrds. | 0 ft. | 7 in. | .0 |
| 146 | 13 yrds. | 1 ft. | 0 in. | .3 |
| 147 | 13 yrds. | 1 ft. | 5 in. | .6 |
| 148 | 13 yrds. | 1 ft. | 10 in. | .9 |
| 149 | 13 yrds. | 2 ft. | 4 in. | .2 |
| 150 | 13 yrds. | 2 ft. | 9 in. | .5 |
| 151 | 14 yrds. | 0 ft. | 2 in. | .8 |
| 152 | 14 yrds. | 0 ft. | 8 in. | .1 |
| 153 | 14 yrds. | 1 ft. | 1 in. | .4 |
| 154 | 14 yrds. | 1 ft. | 6 in. | .7 |
| 155 | 14 yrds. | 2 ft. | 0 in. | .0 |
| 156 | 14 yrds. | 2 ft. | 5 in. | .3 |
| 157 | 14 yrds. | 2 ft. | 10 in. | .3 |
| 158 | 15 yrds. | 0 ft. | 3 in. | .6 |
| 159 | 15 yrds. | 0 ft. | 8 in. | .9 |
| 160 | 15 yrds. | 1 ft. | 2 in. | .2 |
| 161 | 15 yrds. | 1 ft. | 7 in. | .5 |
| 162 | 15 yrds. | 2 ft. | 0 in. | .8 |
| 163 | 15 yrds. | 2 ft. | 6 in. | .1 |
| 164 | 15 yrds. | 2 ft. | 11 in. | .4 |
| 165 | 16 yrds. | 0 ft. | 4 in. | .7 |
| 166 | 16 yrds. | 0 ft. | 10 in. | .0 |
| 167 | 16 yrds. | 1 ft. | 3 in. | .3 |
| 168 | 16 yrds. | 1 ft. | 8 in. | .6 |
| 169 | 16 yrds. | 2 ft. | 1 in. | .9 |
| 170 | 16 yrds. | 2 ft. | 7 in. | .2 |
| 171 | 17 yrds. | 0 ft. | 0 in. | .5 |
| 172 | 17 yrds. | 0 ft. | 5 in. | .8 |
| 173 | 17 yrds. | 0 ft. | 11 in. | .1 |
| 174 | 17 yrds. | 1 ft. | 4 in. | .4 |
| 175 | 17 yrds. | 1 ft. | 9 in. | .7 |
| 176 | 17 yrds. | 2 ft. | 5 in. | .0 |
| 177 | 17 yrds. | 2 ft. | 10 in. | .3 |
| 178 | 18 yrds. | 0 ft. | 3 in. | .6 |
| 179 | 18 yrds. | 0 ft. | 8 in. | .9 |
| 180 | 18 yrds. | 1 ft. | 2 in. | .2 |
| 181 | 18 yrds. | 1 ft. | 7 in. | .5 |
| 182 | 18 yrds. | 2 ft. | 0 in. | .8 |
| 183 | 18 yrds. | 2 ft. | 6 in. | .1 |
| 184 | 18 yrds. | 2 ft. | 11 in. | .4 |
| 185 | 19 yrds. | 0 ft. | 4 in. | .7 |
| 186 | 19 yrds. | 0 ft. | 10 in. | .0 |
| 187 | 19 yrds. | 1 ft. | 3 in. | .3 |
| 188 | 19 yrds. | 1 ft. | 8 in. | .6 |
| 189 | 19 yrds. | 2 ft. | 1 in. | .9 |
| 190 | 19 yrds. | 2 ft. | 7 in. | .5 |
| 191 | 20 yrds. | 0 ft. | 0 in. | .5 |
| 192 | 20 yrds. | 0 ft. | 5 in. | .8 |
| 193 | 20 yrds. | 0 ft. | 11 in. | .1 |
| 194 | 20 yrds. | 1 ft. | 4 in. | .4 |
| 195 | 20 yrds. | 1 ft. | 9 in. | .7 |
| 196 | 20 yrds. | 2 ft. | 3 in. | .0 |
| 197 | 20 yrds. | 2 ft. | 8 in. | .3 |
| 198 | 21 yrds. | 0 ft. | 1 in. | .6 |
| 199 | 21 yrds. | 0 ft. | 6 in. | .9 |
| 200 | 21 yrds. | 1 ft. | 0 in. | .2 |
| 201 | 21 yrds. | 1 ft. | 5 in. | .5 |
| 202 | 21 yrds. | 1 ft. | 10 in. | .8 |
| 203 | 21 yrds. | 2 ft. | 4 in. | .1 |
| 204 | 21 yrds. | 2 ft. | 9 in. | .4 |
| 205 | 22 yrds. | 0 ft. | 2 in. | .7 |
| 206 | 22 yrds. | 0 ft. | 8 in. | .0 |
| 207 | 22 yrds. | 1 ft. | 1 in. | .3 |
| 208 | 22 yrds. | 1 ft. | 6 in. | .6 |
| 209 | 22 yrds. | 1 ft. | 11 in. | .9 |
| 210 | 22 yrds. | 2 ft. | 5 in. | .2 |
| 211 | 22 yrds. | 2 ft. | 10 in. | .5 |
| 212 | 23 yrds. | 0 ft. | 3 in. | .9 |
| 213 | 23 yrds. | 0 ft. | 9 in. | .1 |
| 214 | 23 yrds. | 1 ft. | 2 in. | .4 |
| 215 | 23 yrds. | 1 ft. | 7 in. | .7 |

TABLE I-continued

| SET IN YARDAGES | | | | |
|---|---|---|---|---|
| F.P.S. | YARDS | FEET | INCHES | TENTHS |
| 216 | 23 yrds. | 2 ft. | 1 in. | .0 |
| 217 | 23 yrds. | 2 ft. | 6 in. | .3 |
| 218 | 23 yrds. | 2 ft. | 11 in. | .6 |
| 219 | 24 yrds. | 0 ft. | 4 in. | .9 |
| 220 | 24 yrds. | 0 ft. | 10 in. | .2 |
| 221 | 24 yrds. | 1 ft. | 3 in. | .5 |
| 222 | 24 yrds. | 1 ft. | 8 in. | .8 |
| 223 | 24 yrds. | 2 ft. | 2 in. | .1 |
| 224 | 24 yrds. | 2 ft. | 7 in. | .4 |
| 225 | 25 yrds. | 0 ft. | 0 in. | .7 |
| 226 | 25 yrds. | 0 ft. | 6 in. | .0 |
| 227 | 25 yrds. | 0 ft. | 11 in. | .3 |
| 228 | 25 yrds. | 1 ft. | 4 in. | .6 |
| 229 | 25 yrds. | 1 ft. | 9 in. | .9 |
| 230 | 25 yrds. | 2 ft. | 3 in. | .1 |
| 231 | 25 yrds. | 2 ft. | 8 in. | .5 |
| 232 | 26 yrds. | 0 ft. | 1 in. | .8 |
| 233 | 26 yrds. | 0 ft. | 7 in. | .1 |
| 234 | 26 yrds. | 1 ft. | 0 in. | .4 |
| 235 | 26 yrds. | 1 ft. | 5 in. | .7 |
| 236 | 26 yrds. | 1 ft. | 11 in. | .0 |
| 237 | 26 yrds. | 2 ft. | 4 in. | .3 |
| 238 | 26 yrds. | 2 ft. | 9 in. | .6 |
| 239 | 27 yrds. | 0 ft. | 2 in. | .9 |
| 240 | 27 yrds. | 0 ft. | 9 in. | .2 |
| 241 | 27 yrds. | 1 ft. | 1 in. | .5 |
| 242 | 27 yrds. | 1 ft. | 6 in. | .8 |
| 243 | 27 yrds. | 2 ft. | 0 in. | .1 |
| 244 | 27 yrds. | 2 ft. | 5 in. | .4 |
| 245 | 27 yrds. | 2 ft. | 10 in. | .7 |
| 246 | 28 yrds. | 0 ft. | 4 in. | .0 |
| 247 | 28 yrds. | 0 ft. | 9 in. | .3 |
| 248 | 28 yrds. | 1 ft. | 2 in. | .6 |
| 249 | 28 yrds. | 1 ft. | 7 in. | .9 |
| 250 | 28 yrds. | 2 ft. | 1 in. | .2 |
| 251 | 28 yrds. | 2 ft. | 6 in. | .5 |
| 252 | 28 yrds. | 2 ft. | 11 in. | .8 |
| 253 | 29 yrds. | 0 ft. | 5 in. | .1 |
| 254 | 29 yrds. | 0 ft. | 10 in. | .4 |
| 255 | 29 yrds. | 1 ft. | 3 in. | .7 |
| 256 | 29 yrds. | 1 ft. | 9 in. | .0 |
| 257 | 29 yrds. | 2 ft. | 2 in. | .3 |
| 258 | 29 yrds. | 2 ft. | 7 in. | .6 |
| 259 | 30 yrds. | 0 ft. | 0 in. | .9 |
| 260 | 30 yrds. | 0 ft. | 6 in. | .2 |
| 261 | 30 yrds. | 0 ft. | 11 in. | .5 |
| 262 | 30 yrds. | 1 ft. | 4 in. | .8 |
| 263 | 30 yrds. | 1 ft. | 10 in. | .1 |
| 264 | 30 yrds. | 2 ft. | 3 in. | .4 |
| 265 | 30 yrds. | 2 ft. | 8 in. | .7 |
| 266 | 31 yrds. | 0 ft. | 2 in. | .0 |
| 267 | 31 yrds. | 0 ft. | 7 in. | .3 |
| 268 | 31 yrds. | 1 ft. | 0 in. | .6 |
| 269 | 31 yrds. | 1 ft. | 5 in. | .9 |
| 270 | 31 yrds. | 1 ft. | 11 in. | .2 |
| 271 | 31 yrds. | 2 ft. | 4 in. | .5 |
| 272 | 31 yrds. | 2 ft. | 9 in. | .8 |
| 273 | 32 yrds. | 0 ft. | 3 in. | .1 |
| 274 | 32 yrds. | 0 ft. | 8 in. | .4 |
| 275 | 32 yrds. | 1 ft. | 1 in. | .7 |
| 276 | 32 yrds. | 1 ft. | 7 in. | .0 |
| 277 | 32 yrds. | 2 ft. | 0 in. | .3 |
| 278 | 32 yrds. | 2 ft. | 5 in. | .6 |
| 279 | 32 yrds. | 2 ft. | 10 in. | .9 |
| 280 | 33 yrds. | 0 ft. | 4 in. | .2 |
| 281 | 33 yrds. | 0 ft. | 9 in. | .5 |
| 282 | 33 yrds. | 1 ft. | 2 in. | .8 |
| 283 | 33 yrds. | 1 ft. | 8 in. | .1 |
| 284 | 33 yrds. | 2 ft. | 1 in. | .4 |
| 285 | 33 yrds. | 2 ft. | 6 in. | .7 |
| 286 | 33 yrds. | 0 ft. | 0 in. | .0 |
| 287 | 34 yrds. | 0 ft. | 5 in. | .3 |
| 288 | 34 yrds. | 0 ft. | 10 in. | .6 |
| 289 | 34 yrds. | 1 ft. | 3 in. | .9 |
| 290 | 34 yrds. | 1 ft. | 9 in. | .2 |

TABLE I-continued

| SET IN YARDAGES | | | | |
|---|---|---|---|---|
| F.P.S. | YARDS | FEET | INCHES | TENTHS |
| 291 | 34 yrds. | 2 ft. | 2 in. | .5 |
| 292 | 34 yrds. | 2 ft. | 7 in. | .8 |
| 293 | 35 yrds. | 0 ft. | 1 in. | .1 |
| 294 | 35 yrds. | 0 ft. | 6 in. | .4 |
| 295 | 35 yrds. | 0 ft. | 11 in. | .7 |
| 296 | 35 yrds. | 1 ft. | 5 in. | .0 |
| 297 | 35 yrds. | 1 ft. | 10 in. | .3 |
| 298 | 35 yrds. | 2 ft. | 3 in. | .6 |
| 299 | 35 yrds. | 2 ft. | 8 in. | .9 |
| 300 | 36 yrds. | 0 ft. | 2 in. | .2 |
| 301 | 36 yrds. | 0 ft. | 7 in. | .5 |
| 302 | 36 yrds. | 1 ft. | 0 in. | .8 |
| 303 | 36 yrds. | 1 ft. | 6 in. | .1 |
| 304 | 36 yrds. | 1 ft. | 11 in. | .4 |
| 305 | 36 yrds. | 2 ft. | 4 in. | .7 |
| 306 | 36 yrds. | 2 ft. | 10 in. | .0 |
| 307 | 37 yrds. | 0 ft. | 3 in. | .3 |
| 308 | 37 yrds. | 0 ft. | 6 in. | .6 |
| 309 | 37 yrds. | 1 ft. | 1 in. | .9 |
| 310 | 37 yrds. | 1 ft. | 7 in. | .2 |

Once the set-in distance is established, the ranging aspect of the calibration process is performed. With the archer standing at the set-in distance, a series of targets of known sizes are presented. The known target sizes are based upon the nominal size of a target area of various types of game that might be encountered in the field. For example, it is known that the back to breast height on a deer is approximately 14 inches, so a target 14 inches in height is used for this step. A squirrel will present a target size of about 24 inches, so a target of that size may be used as well. Larger game, such as moose, may present a target area on the order of 30–32 inches, so a target 30–32 inches in height may be used as well.

Each of the different sizes of target is positioned at the set-in distance from the archer. With the sight 100 in its initial position (FIG. 2), and with the bulls-eye pin 150 having previously been set at the home (H, FIG. 5) level, the archer will frame the upper and lower extents of the target with the sight, placing the bulls-eye bar at the top surface of the target, and moving the belly bar 172 in its slot 170 until it appears at the lower surface of the target, as the archer looks through the sight. For each target, the belly bar 172 is tightened in slot 170 such that the target is framed by the bulls-eye pin 150 and belly bar 172. In this part of the process, the sight is to remain at its initial position, as seen in FIG. 2.

Figure 6:
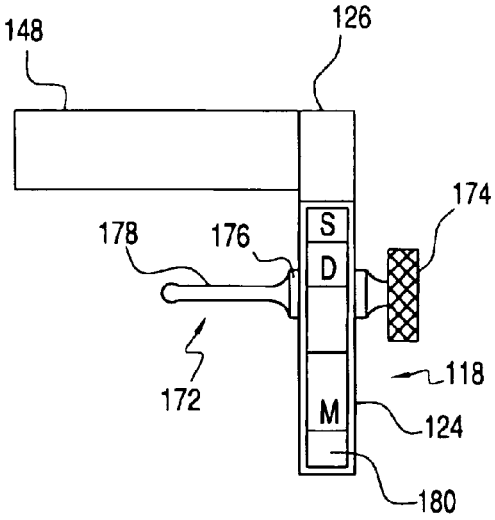
FIG. 6 is a top plan view of the sight plate according to a preferred embodiment of the present application.
Figure 7:
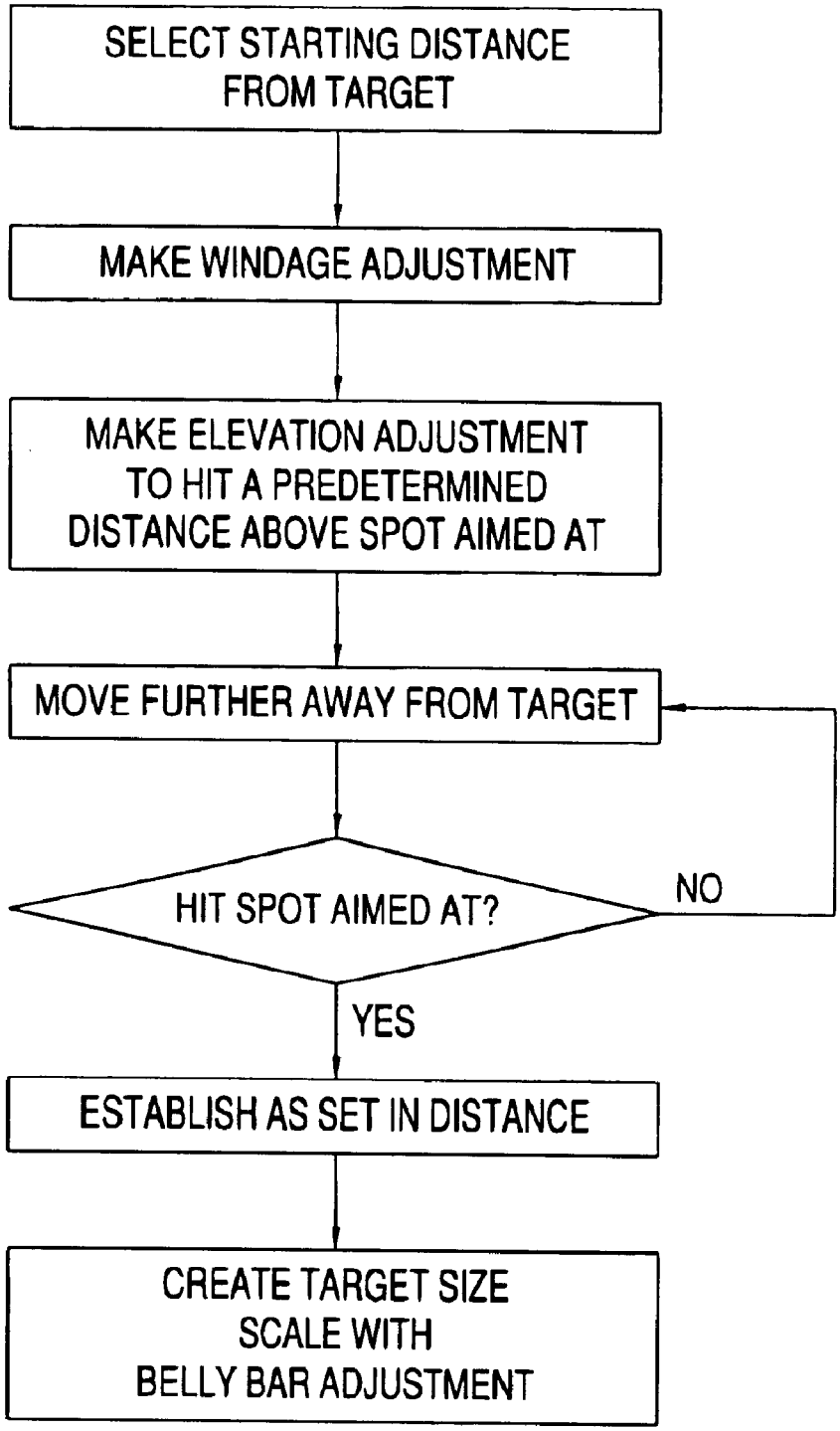
FIG. 7 is a flow chart illustrating the calibration or "set-in" process and initial target size calibration according to a preferred embodiment of the present invention.

A target scale 180 (FIG. 6) is provided on an upper surface of rear leg 124, and the archer will mark the scale with suitable markings representing the positions of the belly bar 172 for each of the various target sizes. For illustrative purposes, the scale 180 is shown as being marked "S" for the position of the belly bar for a squirrel-sized target (about 2–4 inches) at the set-in distance. Similarly a "D" line is marked on the scale for a deer-sized target, and an "M" line for a moose-sized target.

Once these markings are made, the set-in or calibration process is complete. By establishing the belly bar target scale at the set-in distance with the sight in its initial position (FIG. 2), the sight will have effectively been calibrated to accurately perform a ranging function in addition to the aiming function, up to distances of about 75 yards or more.

When the archer takes the bow into the field, only one very simple and quick adjustment need be made to the sight. Upon encountering a particular type of game, the archer will loosen belly bar thumbscrew 174 and position belly bar 172, using scale 180, to the proper target size for that type of game. Once this is effected, the archer will look through the sight, and will need to frame the upper and lower surfaces of the target area with the bulls-eye pin 150 and belly bar 172. Instead of moving the belly bar 172 in slot 120, as was done in the calibration step, the archer will pull on trigger 141 to operate the linkages such that bulls eye pin 150 and belly bar 172 move closer together (see FIGS. 2, 3, 4) in a vertical direction, until the bulls-eye pin 150 is at the top surface of the target/game, and the belly bar 172 is at the bottom surface of the target/game, when looking through the sight and having the bow at full draw. A particular size of target (e.g., a deer) will appear to be smaller at increasing distances, and the framing of the target with the bulls-eye pin and belly bar performs a ranging function based on this principle.

Figure 3:
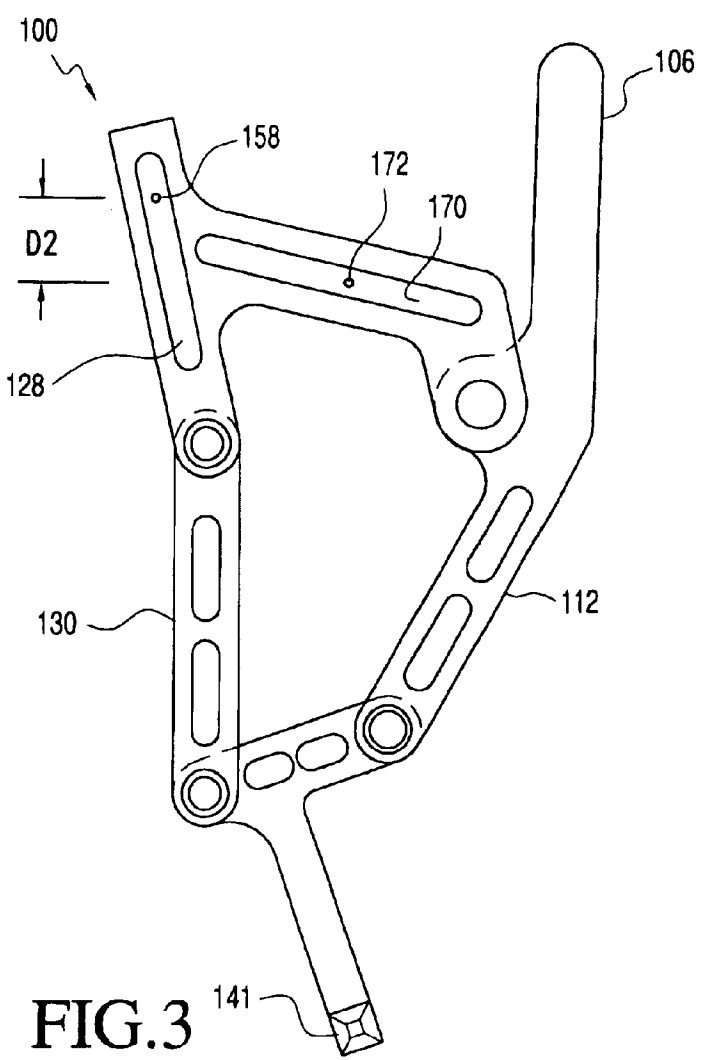
FIG. 3 is a side elevation view of the target sight and range finder at a position moved from the initial position.
Figure 4:
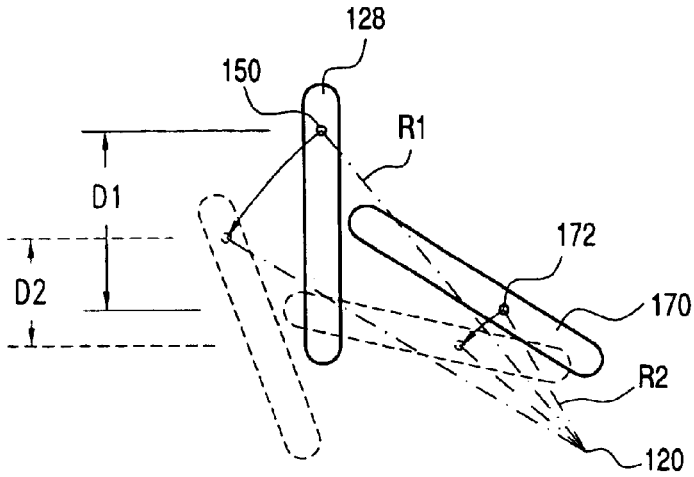
FIG. 4 is a diagrammatical view of the movement of the bulls-eye bar and belly bar, in accordance with a preferred embodiment of the present invention.

The archer, when holding the bow at full draw, will see the movement of bulls-eye pin 150 and belly bar 172 as purely vertical movement, even though, as seen in FIG. 4, the bulls-eye pin and belly bar actually travel in arcs along two different radii. The symbols D1 and D2 are used to illustrate the distance of the vertical separation of the bulls-eye pin and belly bar, as seen by the archer, at the initial position (D1, FIG. 2), where the trigger is all of the way forward, and at a second position (D2, FIG. 3) after the archer has pulled the trigger to frame the target between the bulls-eye pin and the belly bar.

It can be seen, in comparing FIGS. 2 and 3, and also in looking at FIG. 4, that when the trigger 141 is pulled to move the bulls-eye pin and belly bar closer together vertically, the bulls-eye pin travels through an arc that moves the bulls-eye pin vertically lower. Since the archer must keep the bulls-eye pin at the top surface of the target, he/she will have to raise the bow as bulls-eye pin moves lower in this vertical direction. This has the effect of having the archer automatically shoot at an increased trajectory to compensate for the increased archer-to-target distance. Once the target is thus framed, i.e., once the ranging is effected, the archer will then aim the fiber optic bead of the bulls-eye pin at the desired impact point on the target.

The particular sight construction, which moves the bulls-eye pin 150 and belly bar 172 through arcs of two different radii R1, R2 (see FIG. 4), about a common pivot point at clutch bolt 120 in combination with the calibration or set in process, which factors in the variations in arrow speed caused particularly by different bow constructions, has demonstrated in tests that this sight provides highly accurate ranging and aiming functions at distances up to about 75 yards and beyond, for a wide variety of target sizes. Because of the target size adjustment, in which the belly bar is moved to a desired position in slot 120, using scale 180, the radius R2 will vary based upon where the belly bar is positioned. This variance of the R2 radius based upon target size is also believed to operate to enhance the accuracy of the sight.

The sight 100 has also been shown to be accurate, without further calibration or adjustment when shooting from elevated positions, up to about 20–25 feet above the target. Further, as seen in FIG. 5, the sight bar scale 152 can be marked with fixed distance indicia such that the bow can be used for known, fixed distance shooting without the requirement to use the ranging. (framing) function, such as when taking target practice from a single distance or in competitions. These markings are generated leaving the elevation adjustment of the sight at the same position as used in the set-in or calibration process, and shooting from a known distance, for example 40 yards, using the bulls-eye pin to aim at the bulls-eye or other designated spot on the target. Leaving the elevation adjustment fixed, the level of the bulls-eye pin 150 is raised or lowered within slot 128, and tightened with thumbscrew 154, until the archer is able to aim at the bulls-eye/designated spot with the bulls-eye pin, and able to hit that spot regularly. The scale 152 is then marked to indicate the required position for the bulls-eye pin in slot 128 for shooting at that distance.

As such, the sight is able to function as a sight for fixed distance shooting without affecting the set-in or calibration of the sight when used in the ranging mode for non-fixed distance shooting.

The sight of the present invention is not limited to use in archery applications, although that is the use for which it was originally developed. A sight according to the present invention can be used for aiming and ranging in connection with any system in which projectiles having repeatable, regular initial launch characteristics are shot or launched. The set-in calibration process, as well as the target sizing process would remain essentially the same.

The foregoing description and illustrations of the preferred embodiment are presented for illustrative purposes, and the invention is not to be limited strictly to the embodiment described. Variations and modifications of the device may become apparent to those of ordinary skill in the art, and such variations and modifications will fall within the scope of spirit of the present invention.

What is claimed is:

1. A sight for use in aiming a projectile at a target comprising:

a main frame member capable of being positioned in a substantially vertical orientation, and having a lower link element rigidly affixed thereto and depending downwardly therefrom, said main frame member further having a flange extending forwardly therefrom;

a sight plate comprising a rear leg pivotably attached to said flange on said main frame member, said rear leg extending forwardly and angled upwardly from said flange, and a forward sight bar affixed to a forward extent of said rear leg, said sight plate having a first slot extending through and along a predetermined portion of said rear leg;

an aiming pin secured to said forward sight bar and a ranging pin secured in said first slot of said rear leg in a manner such that the position of the ranging pin can be adjusted along the length of the slot;

a forward link pivotably connected to said forward sight bar at a lower extent of said forward sight bar, said forward link extending generally downwardly from said forward sight bar;

a trigger link pivotably connected, at its forward extent, to a lower extent of said forward link and pivotably connected, at its rearward extent, to a lower end of said lower link element, said trigger link having a trigger element projecting from said link;

wherein said sight is so constructed and arranged such that, at an initial position, said forward sight bar and said main frame member are in a substantially parallel orientation with respect to each other, and wherein said trigger may be moved so as to cause said sight plate, said forward link and said trigger link to pivot at their respective pivotable connections to move said aiming pin and said ranging pin through first and second arcs having different radii, in changing a distance, measured in a plane parallel to said main frame member, between said aiming pin and said ranging pin.

2. A method for calibrating a sight as claimed in claim 1, for use in ranging the distance to a target and in aiming a projectile at said target, comprising:

selecting a distance from which to shoot at a target in calibrating the sight;

setting the sight to said initial position;

making any necessary windage adjustments;

making an elevation adjustment such that, when said aiming pin is aimed at a desired hit point on the target, projectiles will hit said target at a predetermined distance above said desired hit point;

incrementally moving farther away from said target until at a distance at which, when said aiming pin is aimed at said desired hit point, projectiles will hit said desired hit point;

designating the distance from the target at which this occurs to be a set-in distance;

with said sight in said initial position, placing a plurality of targets of different sizes at the set-in distance away from the sight;

for each of said plurality of targets, viewing through the sight and moving the sight such that said aiming pin is positioned at a top edge of the target, and then adjusting the position of said ranging pin within said first slot to a range position, at which said ranging pin is positioned at a lower edge of said target, when viewing through the sight;

marking, on said rear leg, the range position of said ranging pin for each of said plurality of target sizes.

* * * * *

UNITED STATES PATENT AND TRADEMARK OFFICE

CERTIFICATE OF CORRECTION

PATENT NO. : 6,868,614 B2
DATED : March 22, 2005
INVENTOR(S) : Floied et al.

It is certified that error appears in the above-identified patent and that said Letters Patent is hereby corrected as shown below:

Title page,
Item [73], Assignee, delete "Rack-Spur LLC" and replace with
-- Rack-N-Spur LLC --

Signed and Sealed this

Nineteenth Day of July, 2005

JON W. DUDAS
*Director of the United States Patent and Trademark Office*